United States Patent [19]

Wada et al.

[11] Patent Number: 4,657,065

[45] Date of Patent: Apr. 14, 1987

[54] COMPOSITE MATERIALS HAVING A MATRIX OF MAGNESIUM OR MAGNESIUM ALLOY REINFORCED WITH DISCONTINUOUS SILICON CARBIDE PARTICLES

[75] Inventors: Tsuguyasu Wada, Ann Arbor; George T. Eldis, Ypsilanti; Darryl L. Albright, Ann Arbor, all of Mich.

[73] Assignee: Amax Inc., Greenwich, Conn.

[21] Appl. No.: 884,123

[22] Filed: Jul. 10, 1986

[51] Int. Cl.[4] ..... B22D 19/14

[52] U.S. Cl. ..... 164/461; 164/97

[58] Field of Search ..... 164/97, 108, 109, 110, 164/461, 57.1, 58.1

[56] References Cited

U.S. PATENT DOCUMENTS 4,053,011 10/1977 Riewald et al. ..... 164/97

*Primary Examiner*—Kuang Y. Lin

*Attorney, Agent, or Firm*—Michael A. Ciomek; Eugene J. Kalil

[57] ABSTRACT

Reinforced composite magnesium-matrix articles, containing silicon carbide fibers or particles, are produced by a casting process wherein a small amount of lithium, less than about 0.7% by weight, is included in a melt of magnesium matrix alloy to facilitate wetting of the reinforcing material and ready dispersal thereof in the magnesium matrix alloy.

7 Claims, No Drawings

COMPOSITE MATERIALS HAVING A MATRIX OF MAGNESIUM OR MAGNESIUM ALLOY REINFORCED WITH DISCONTINUOUS SILICON CARBIDE PARTICLES

The present invention is directed to the production of composite articles, having a matrix of magnesium or magnesium alloy and reinforced with discontinuous silicon carbide particles, which are made by a casting process.

BACKGROUND OF THE INVENTION

Magnesium and its alloys are useful industrial materials principally due to the light weight and high strength to weight ratios which characterize them. Nevertheless, these materials possess disadvantages which inhibit their use in many applications. Thus, the alloys are comparatively soft and are subject to galling and seizing when engaged in rubbing friction under load. The modulus of the alloys also is lower than that which would be desirable in certain applications. Property improvements have been achieved through the use of alloying additions but even further improvements would be of benefit.

Pressures to provide even greater property improvements together with the provision of property combinations heretofore unobtainable have lead to consideration of magnesium and its alloys as a constituent of a composite system. As an example, greater strengths have been obtained in aluminum alloy materials by using alumina fibers bonded to an aluminum alloy matrix as taught in U.S. Pat. No. 4,012,204.

Methods commonly used to prepare metal-matrix composite materials may be classified into three categories; namely, (1) Solid-state or semi-solid-state consolidation
(2) Pressure infiltration or squeeze casting
(3) Casting; a process in which reinforcing materials, normally having little or no solubility in the matrix material, are mixed with the matrix metal or alloy at a temperature above the liquidus temperature of the matrix material. The molten mixture containing reinforcing material in suspension is then solidified. It is essential that the reinforcing material be wetted by the melt, as otherwise it will be rejected and no reinforcement will result. This has been recognized, for example, in U.S. Pat. No. 3,885,959 which teaches coating the surface of the reinforcing particles with nickel to promote wetting.

Technical development of the casting method is less advanced than the methods of Categories 1 and 2. The technique offers advantages in applications for producing relatively large size ingots at reasonable cost.

SUMMARY OF THE INVENTION

In accordance with the invention, non-oxide reinforcing materials from the group consisting of silicon carbide fibers and silicon carbide particles may be dispersed in a molten bath of magnesium alloy which contains about 0.2% to about 0.7%, by weight, of lithium; by mixing the solid discontinuous phase material with the magnesium alloy bath for a time sufficient to provide substantially complete dispersion of the solid material throughout the bath and then solidifying the bath while maintaining the dispersion.

DETAILED DESCRIPTION OF THE INVENTION

In accordance with the invention, the magnesium alloy bath to form the matrix of the final composite material may contain in addition to the requisite 0.2% to about 0.7%, by weight, of lithium, up to about 2% copper, up to about 3% silicon, up to about 12% aluminum, up to about 15% zinc; up to about 2% zirconium, up to about 1% tin, up to about 1% iron, and the balance essentially magnesium.

The lithium present in the molten magnesium alloy bath aids in wetting the reinforcing material. For this purpose, a lithium content up to about 0.7%, by weight, is sufficient although lithium contents lower than about 0.2% by wt. of the bath are insufficient. The lithium content is kept below about 1%, since the vapor pressure of lithium at the temperatures of the molten magnesium alloy is high, resulting in rapid loss of lithium. In addition, excessive lithium contents in the bath produce difficulties in melting practice.

Particulate silicon carbide materials used in accordance with the invention will generally have an average particle size less than about 200 microns; e.g. about 5 to about 100 microns. Fibers introduced as dispersions may have an average diameter of about 8 to about 20 microns and an average length of about 200 to about 1000 microns.

The magnesium alloy matrix material may also contain elements such as copper and/or zirconium and/or silicon which contribute hardenability to the matrix. Titanium carbide fibers or particles can also be introduced in amounts up to 5% by volume, as titanium carbide surfaces are wetted by molten magnesium.

In producing the composite materials of the invention, the magnesium base matrix alloy is melted in a crucible which may, for example, be made of graphite. A appropriate amount of lithium either as metallic lithium or as a master alloy containing up to about 20% lithium, e.g. 10% lithium, balance magnesium, may be introduced into the molten matrix alloy. The desired reinforcing material is then added in an amount of about 5% up to about 25%, e.g., about 20% by volume is added and mixed mechanically as by stirring. No pretreatment of the reinforcing material is necessary. The mixture of the molten metal alloy and particulate or fibrous silicon carbide is solidified either by casting into a mold or by cooling in the melting crucible. Continuous casting of the mixture may also be undertaken. The process can be carried out in the atmosphere. The solidified ingot may be further processed by extrusion, press-forging at a temperature at which the matrix alloy is partially melted, or by other forming processes or combinations thereof.

Examples will now be given.

A charge weighing 345 grams of magnesium alloy containing 9% aluminum and 1% zinc was melted in a graphite crucible surrounded by a vertical tubular furnace. Two grams of lithium were added to the molten metal and mixed therewith by stirring. Silicon carbide reinforcing materials, 325 mesh minus/200 mesh plus particles, of about 14.7% by weight, were added to the molten alloy and mixed by stirring using a screw-type motorized stirrer having four blades made of molybdenum. In this case, good mixing of silicon carbide material with the magnesium alloy melt was achieved. The crucible was then removed from the furnace and cooled by forced air.

For comparison, 383 grams of magnesium alloy containing 9% aluminum and 1% zinc was melted in the same way. About 50 grams of flux consisting of mixed alkaline chlorides were added, but no lithium was added. Then 60 grams of SiC particulates were added and mixed by stirring, but no wetting with the molten metal was observed in this case.

The composite aforementioned showed a hardness of 104 HV10 in the as-cast condition, whereas a matrix alloy without the reinforcing material showed 83 HV10 in the same condition. Thus, about a 25% increase in hardness was obtained with the reinforcement by SiC. Other properties such as tensile strength and wear resistance are also expected to be improved by the addition of SiC.

It will of course be appreciated that fibrous materials distributed throughout a magnesium metal matrix by mixing will be randomly dispersed but will nevertheless strengthen the matrix as long as the fiber is wetted by the molten matrix metal and is firmly bonded thereto in the solid state.

Composite materials produced in accordance with the invention such as magnesium alloy matrix material strengthened with about 5% to about 25%, by volume, of silicon carbide particles are useful in applications such as pulleys, sheaves, chain enclosures, bearing surfaces, and connecting rods for pistons.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

What is claimed is:

1. The method for producing a composite material having a matrix of magnesium-base alloy and up to 25%, by volume, of a discontinuous phase from the group consisting of silicon carbide particles and silicon carbide fibers, up to about 5%, by volume, of titanium carbide particles, which comprises preparing a bath of said magnesium-base alloy containing about 0.2% to about 0.7%, by weight, lithium, mixing said discontinuous phase material with said bath at a temperature above the liquidus temperature thereof for a time sufficient to provide substantially complete dispersion of said material throughout said bath and solidifying said bath while maintaining said dispersion.

2. The method in accordance with claim 1, wherein said magnesium-base alloy consists essentially of, by weight, up to about 2% copper, up to about 3% silicon, up to about 12% aluminum, up to about 15% zinc, up to about 2% zirconium, up to about 1% tin, up to about 1% iron and the balance essentially magnesium.

3. The method in accordance with claim 1 wherein said particles have an average size of about 5 to less than about 200 microns.

4. The method in accordance with claim 1 wherein said fibers have an average diameter of about 8 to about 20 microns and an average length of about 200 to about 1000 microns.

5. The method in accordance with claim 1 wherein said mixing is accomplished by stirring.

6. The method in accordance with claim 1 wherein said mixed bath is cast into a static mold.

7. The method in accordance with claim 1 wherein said mixed bath is solidified by continuous casting.

* * * * *